US007922625B2

(12) United States Patent
Grind

(10) Patent No.: US 7,922,625 B2
(45) Date of Patent: Apr. 12, 2011

(54) ADAPTIVE MOTION EXERCISE DEVICE WITH OSCILLATING TRACK

(75) Inventor: Steven M. Grind, Seattle, WA (US)

(73) Assignee: Precor Incorporated, Woodinville, WA (US)

( * ) Notice: Subject to any disclaimer, the term of this patent is extended or adjusted under 35 U.S.C. 154(b) by 0 days.

(21) Appl. No.: 12/317,585

(22) Filed: Dec. 29, 2008

(65) Prior Publication Data

US 2010/0167877 A1 Jul. 1, 2010

(51) Int. Cl.
*A63B 22/04* (2006.01)
*A63B 69/18* (2006.01)

(52) U.S. Cl. ..... 482/52; 482/70

(58) Field of Classification Search ..... 482/35, 482/37, 52, 70, 71
See application file for complete search history.

(56) References Cited

U.S. PATENT DOCUMENTS

| | | | | |
|---|---|---|---|---|
| 5,919,118 | A * | 7/1999 | Stearns et al. | 482/51 |
| 6,152,859 | A * | 11/2000 | Stearns | 482/52 |
| 6,165,107 | A * | 12/2000 | Birrell | 482/70 |
| 6,196,948 | B1 * | 3/2001 | Stearns et al. | 482/52 |
| 6,277,054 | B1 * | 8/2001 | Kuo | 482/51 |
| 6,361,476 | B1 * | 3/2002 | Eschenbach | 482/52 |
| 6,840,892 | B1 * | 1/2005 | Wu | 482/51 |
| 7,104,929 | B1 * | 9/2006 | Eschenbach | 482/52 |
| 7,121,984 | B1 * | 10/2006 | Hong | 482/52 |
| 7,377,881 | B2 | 5/2008 | Nardone | 482/52 |
| 2001/0001305 | A1 * | 5/2001 | Stearns et al. | 482/66 |
| 2001/0036886 | A1 * | 11/2001 | Eschenbach | 482/142 |
| 2004/0224825 | A1 * | 11/2004 | Giannelli et al. | 482/52 |
| 2005/0101446 | A1 * | 5/2005 | Stearns et al. | 482/52 |
| 2005/0124466 | A1 * | 6/2005 | Rodgers, Jr. | 482/52 |
| 2005/0124467 | A1 * | 6/2005 | Rodgers, Jr. | 482/52 |
| 2006/0199702 | A1 * | 9/2006 | Eschenbach | 482/52 |
| 2006/0217234 | A1 * | 9/2006 | Rodgers, Jr. | 482/52 |
| 2006/0234838 | A1 * | 10/2006 | Dalebout et al. | 482/57 |
| 2007/0032348 | A1 * | 2/2007 | Hong | 482/52 |
| 2007/0087906 | A1 * | 4/2007 | Rodgers, Jr. | 482/52 |
| 2007/0087907 | A1 * | 4/2007 | Rodgers, Jr. | 482/52 |
| 2007/0219061 | A1 * | 9/2007 | Rodgers, Jr. | 482/52 |
| 2007/0219062 | A1 * | 9/2007 | Rodgers, Jr. | 482/52 |
| 2007/0232457 | A1 * | 10/2007 | Porth | 482/51 |
| 2007/0298936 | A1 * | 12/2007 | Ohrt et al. | 482/52 |
| 2008/0051260 | A1 | 2/2008 | Simonson et al. | 482/52 |
| 2008/0064572 | A1 | 3/2008 | Nardone | 482/52 |
| 2008/0161164 | A1 * | 7/2008 | Stewart et al. | 482/52 |

OTHER PUBLICATIONS

Dictionary definitions.*

* cited by examiner

*Primary Examiner* — Loan Thanh
*Assistant Examiner* — Shila Abyaneh
(74) *Attorney, Agent, or Firm* — Terence P. O'Brien; Todd A. Rathe

(57) ABSTRACT

An exercise device includes a first foot link and a second foot link. The first foot link has a first portion and a second portion linearly guided along a first axis. The first portion of the first foot link is pivotable about a second axis perpendicular to the first axis. The second portion is pivotable of the first foot link is pivotable about an oscillating third axis perpendicular to the first axis. The second foot link has a first portion and a second portion linearly guided along a fourth axis parallel to the first axis. The second portion of the second foot link is pivotable about a fifth axis perpendicular to the fourth axis. The first portion of the second foot link is pivotable about an oscillating sixth axis perpendicular to the fourth axis.

20 Claims, 8 Drawing Sheets

ADAPTIVE MOTION EXERCISE DEVICE WITH OSCILLATING TRACK

BACKGROUND

Most exercise devices provide a fixed predetermined exercise path of motion. Some exercise devices now provide a user-defined exercise path of motion. However, such exercise devices utilize structural elements that are cantilevered, increasing structural rigidity requirements and increasing overall weight of the exercise device.

DETAILED DESCRIPTION OF THE EXAMPLE EMBODIMENTS

Figure 1:
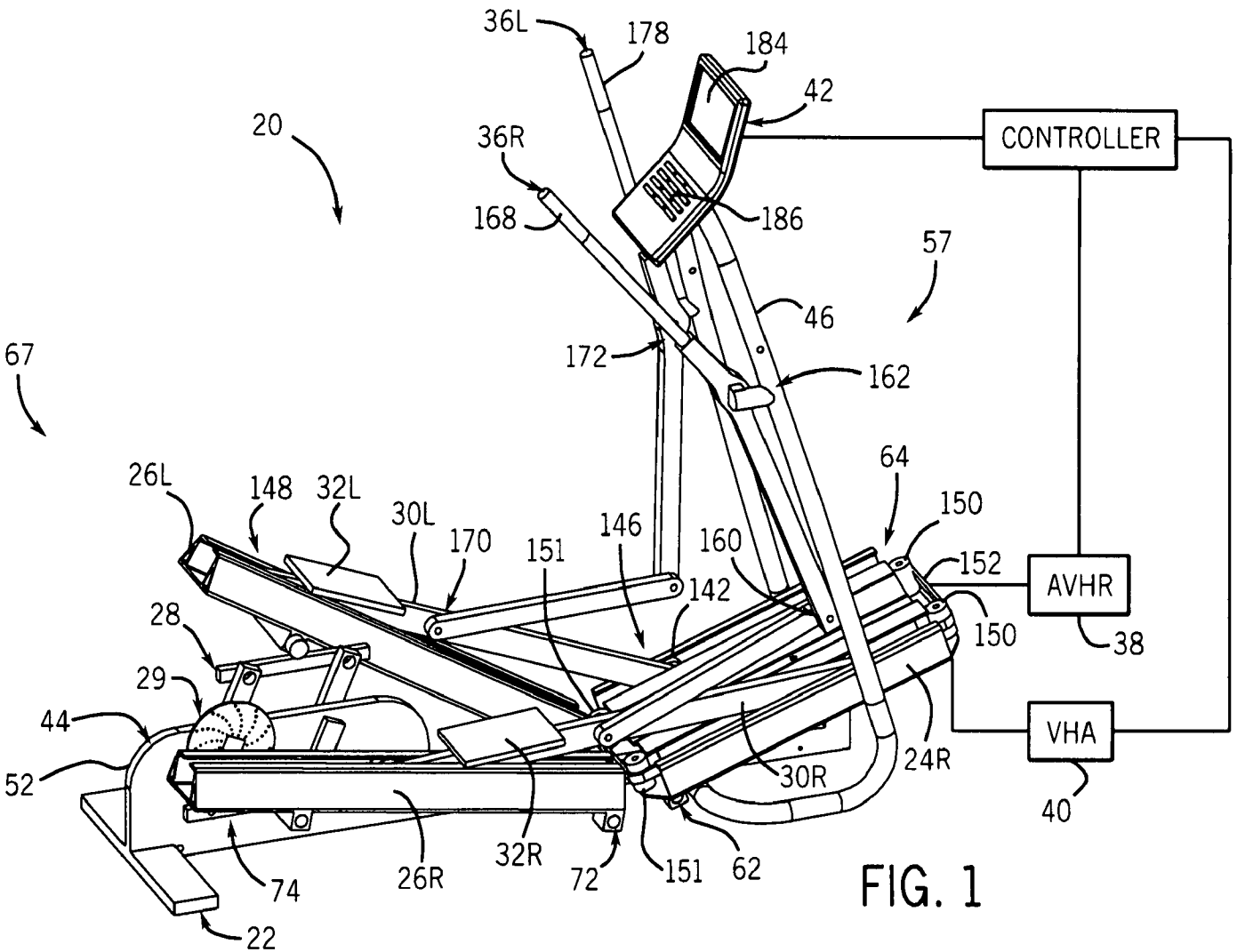
FIG. 1 is a rear perspective view of an exercise device according to an example embodiment.

FIG. 1 illustrates exercise device 20 according to an example embodiment. As will be described hereafter, exercise device 20 provides a person exercising with a plurality of user selectable motion paths. The user is able to change between different available paths by simply applying different forces to foot links of the exercise device. In other words, exercised device 20 is an adaptive motion exercise device in that it automatically adapts or responds to motion of the person exercising. Exercise device 20 provides such freedom of motion with relatively few, if any, cantilevered structural elements. As a result, the structural rigidity and the overall weight of exercise device 20 may be reduced.

Exercise device 20 includes frame 22, ramps 24R, 24L (collectively referred to as ramps 24), tracks 26R, 26L (collectively referred to as tracks 26) track drive 28, adjustable variable vertical resistance source 29, foot link assemblies 30R, 30L (collectively referred to as foot link assemblies 30), foot pads 32R, 32L (collectively referred to as foot pads 32) foot link synchronizer 34, swing arms 36R, 36L (collectively referred to as having arms 36), adjustable variable horizontal resistance source 38, variable height actuator 40 and control panel 42. The frame 22 comprises one or more structures fastened, bonded, welded or integrally formed with one another just to form a base, foundation or main support body configured to support remaining components of exercise device 20. Portions of frame 22 and further serve to assist in stabilizing exercise device 20 as well as to provide structures that a person exercising may engage or grasp during exercise or when mounting a de-mounting exercise device 20.

Figure 2:
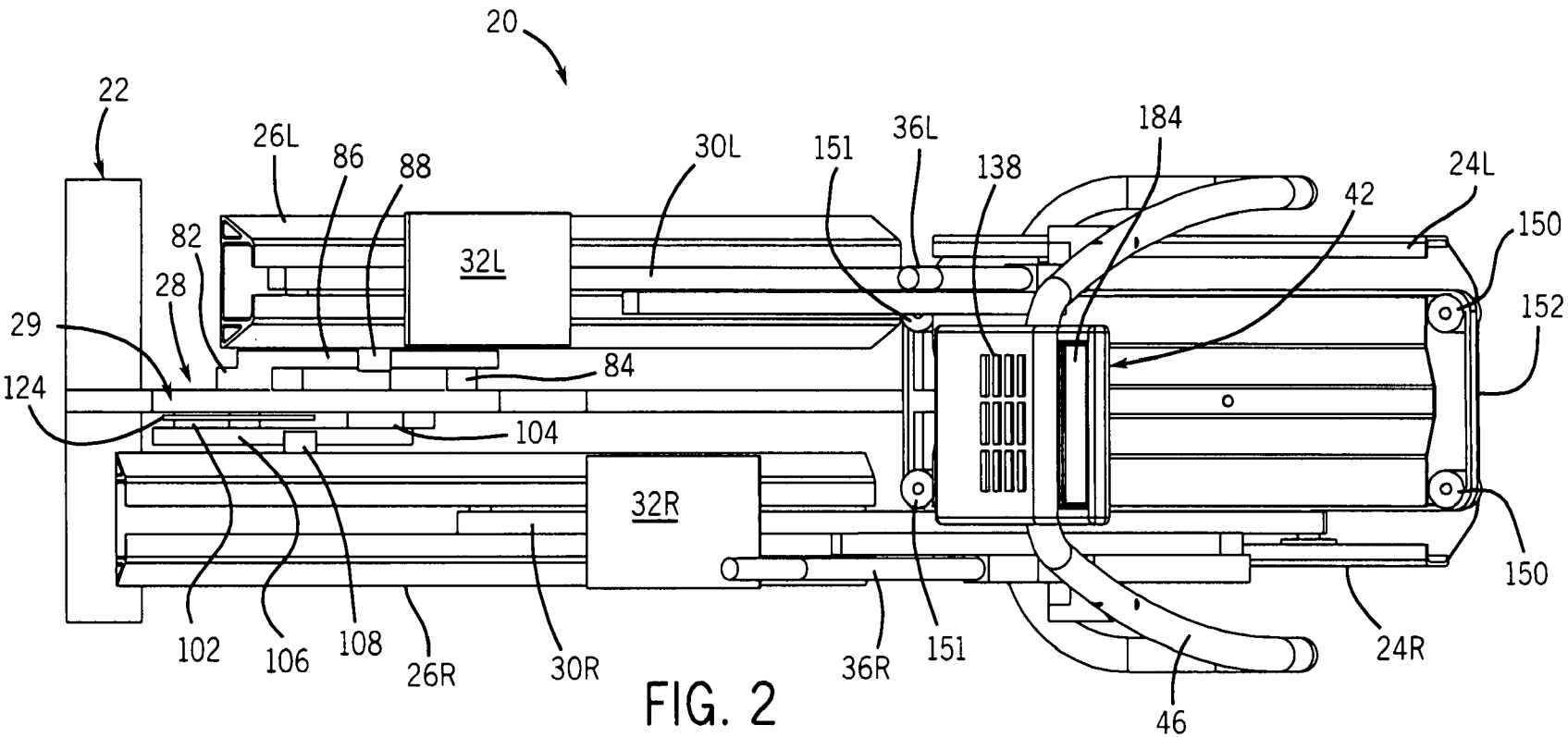
FIG. 2 is a top plan view of the exercise device of FIG. 1.
Figure 3:
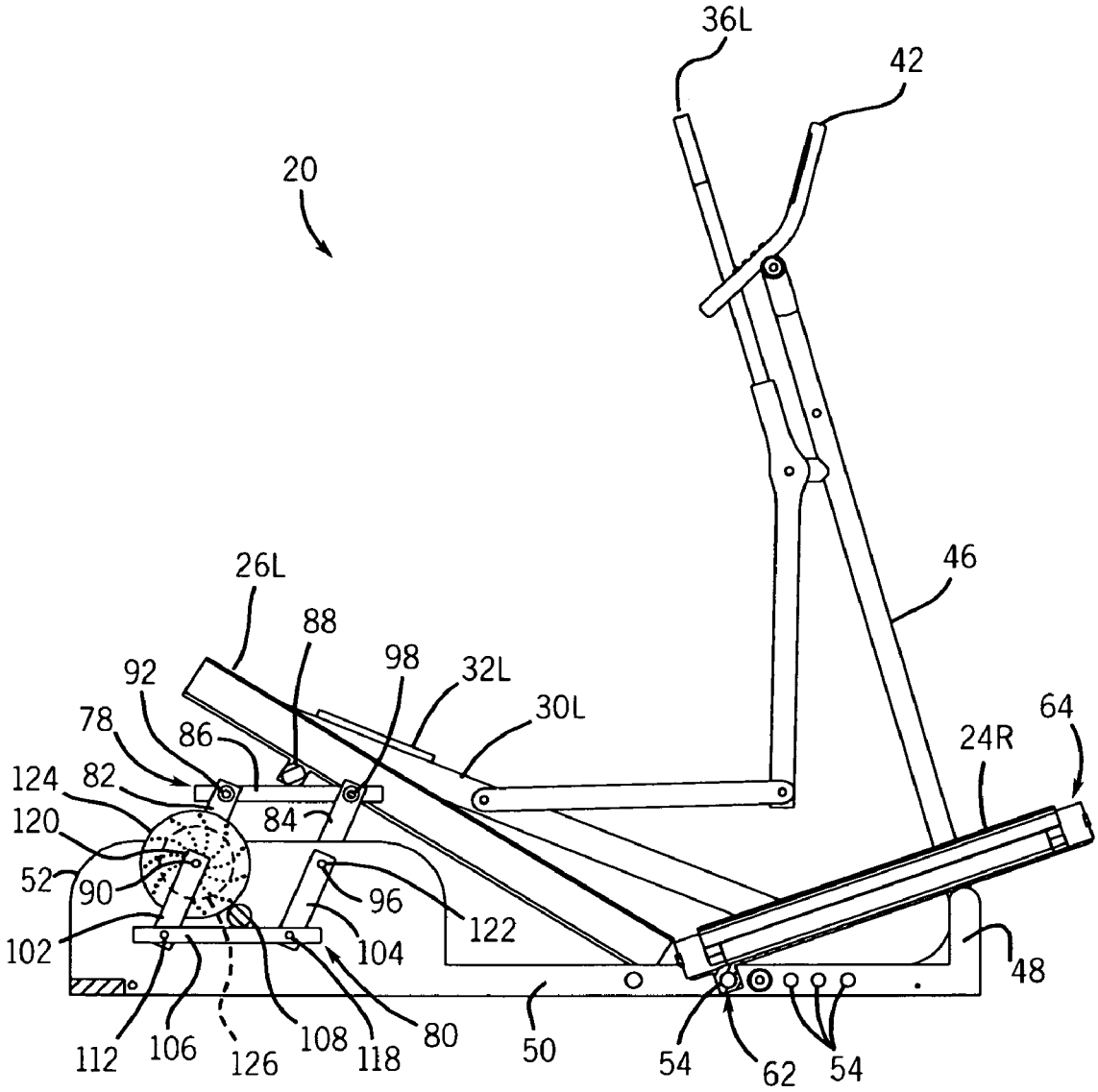
FIG. 3 is a sectional view of the exercise device of FIG. 1.

As shown by FIG. 2, frame 22 includes base 44 and upright 46. Base 44 comprises one or more structures extending along a bottom of exercise device 20 configured to support exercise device 20 upon a support surface, floor, foundation and the like. As shown by FIG. 3, base 44 includes ramp elevating portion 48, pivot mounting portion 50 and track supporting portion 52. Ramp elevating portion 48 extends operably and is configured to elevate ramps 24 with respect to the floor foundation. Ramp elevating portion 48 provides a minimum angle of inclination for ramps 24. In other embodiments in which vertical height actuator 40 provides such minimum elevation, ramp elevating portion 48 may be omitted.

Pivot mounting portion 50 extends between ramp elevating portion 48 and track supporting portion 52. Pivot mounting portion 50 pivotally supports are pivotally connected to each of ramps 24 and tracks 26. In other embodiments, pivot mounting portion 50 may include a plurality of mounting locations 54 at which ramps 24 may be connected to portion 50 so as to permit adjustment of an angle of inclination of ramps 24. In embodiments where ramps 24 are fixed to frame 22 or are otherwise not adjustable, portion 50 may alternatively be pivotally connected to only tracks 26.

Track supporting portion 52 comprises that portion of frame 22 configured to support track drive 28. In the example illustrated, track supporting portion 52 elevates track drive 28 above the ground or other foundation supporting exercise device 20. Supporting portion 52 establishes a minimum elevation or angle of inclination of tracks 26. In other embodiments in which a separate vertical height adjuster or vertical height actuator is provided to selectively adjust a range of the oscillating height or angle of inclination of tracks 26 (described hereafter), supporting portion 52 may be omitted or may be indirectly coupled to track drive 28 by the additional vertical height adjuster or vertical height actuator.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Upright 46 extends upwardly from base 44 at a forward or front end 57 of exercise device 20. Upright 46 supports control panel 42. Upright 46 further pivotally supports swing arms 36. In still other embodiments, upright 46 may be omitted.

Ramps 24 comprises one or more structures at a front end 57 of exercise device 20 that are configured to guide linear movement or linear reciprocation of a portion of foot link assemblies 30. Each of ramps 24 has a first end 62 connected to portion 50 of frame 22 and a second elevated end 64 supported by elevating portion 48 of frame 22. In the example illustrated, each of ramps 24 is pivotally coupled to portion 50 of frame 22 at end 62 (shown in FIG. 3), wherein end 64 is selectively raised and lowered by variable height actuator 40 to adjust inclination angle of ramps 64. In other embodiments, ends 62 may be attached to portion 50 of frame 22 at any of the various one of connection points 54 to adjust an inclination angle of ramps 24. In yet other embodiments, at least one of ends 62, 64 of ramps 24 may be fixed in place relative to frame 22 so as to provide a single inclination angle.

Figure 4:
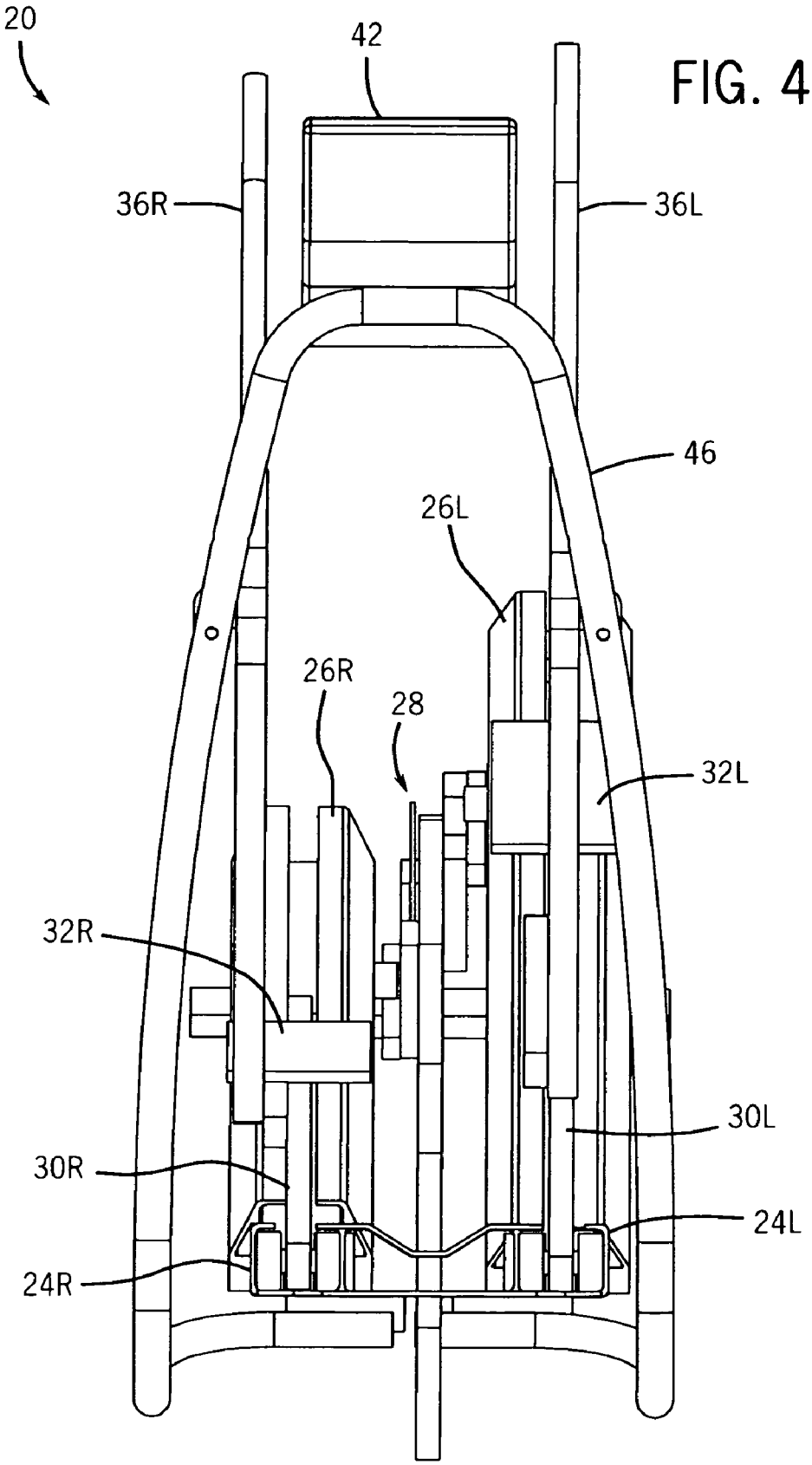
FIG. 4 is another sectional view of the exercise device of FIG. 1.

As shown by FIG. 4, in the example illustrated, ramps 24 each comprise a U-shaped or C-shaped channel configured to slightly receive a portion of one of foot link assemblies 30. As a result, ramps 24 more securely guide reciprocal movement of foot link assemblies 30 also serving as a shield. In the example illustrated, ramps 24 are integrally formed with one another as part of a single unitary body. In the example illustrated, ramps 24 are extruded. As a result, fabrication and assembly of ramps 24 as part of exercise device 20 is simplified and costs are reduced. In other embodiments, ramps 24 may have other configurations.

Tracks 26 comprises one or more structures at a rear end 67 of exercise device 20 that are configured to guide linear movement, translation or linear reciprocation of a portion of foot link assemblies 30. Each of tracks 26 has a first end 72 pivotally connected to portion 50 of frame 22 and a second elevated end 74 elevated and supported by track drive 28 and drive supporting portion 52 of frame 22. In the example illustrated, tracks 26R and 26L extend along and guide reciprocal movement of foot link assemblies 30 along parallel axes. In the example illustrated, the axes along which tracks 26R and 26L extend are contiguous with the same tracks that ramps 24R and 24L, respectively, extend.

Figure 5:
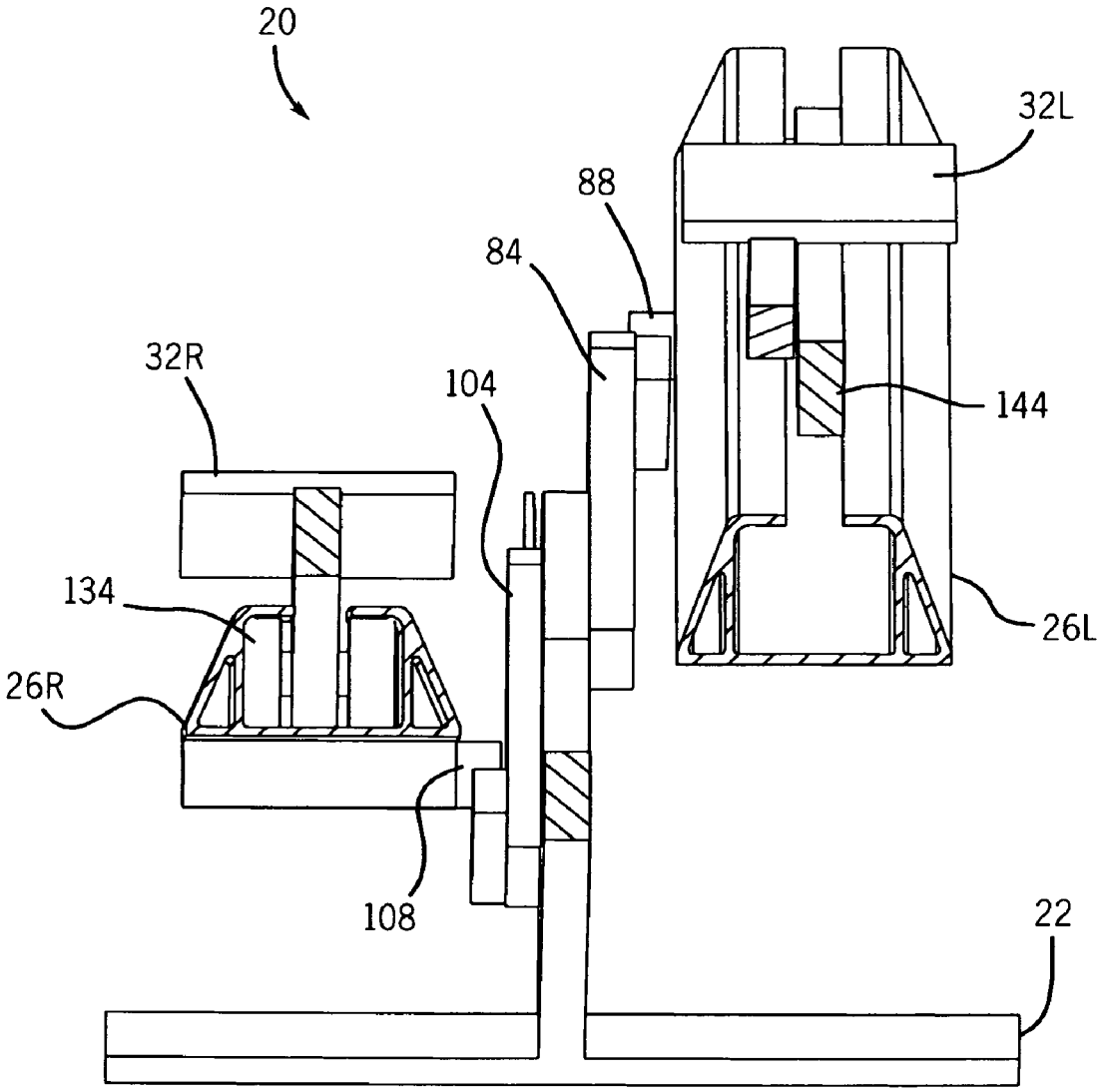
FIG. 5 is another sectional view of the exercise device of FIG. 1.

As shown by FIGS. 1 and 5, in the example illustrated, tracks 26 each comprise a U-shaped or C-shaped channel configured to slidably receive a portion of one of foot link assemblies 30. As a result, tracks 26 more securely guide reciprocal movement of foot link assemblies 30 also serving as a shield. In the example illustrated, tracks 26 comprise separate structures that oscillate with respect to one another 180 degrees out of phase with one another. In the example illustrated, tracks 26 are extruded. As a result, fabrication and assembly of tracks 26 as part of exercise device 20 are simplified and costs are reduced. In other embodiments, tracks 26 may have other configurations.

Track drive 28 comprises a drive mechanism configured to oscillate end 74 of tracks 26. For purposes of this disclosure, the term "oscillate" means to swing or move to and fro. As shown by FIG. 3, track drive 28 includes a left drive 78 (shown in FIG. 2) and a right drive 80 (shown in FIG. 3). Left drive 78 includes crank arms 82, 84, cross-link 86 and roller support 88. Crank arm 82 comprises an elongate structure having a first portion pivotably or rotationally coupled to portion 52 of frame 22 so as to pivot or rotate about axis 90 and a second portion pivotably or rotationally coupled or connected to cross-link 86 so as to pivot or rotate about axis 92. Similarly, crank arm 84 comprises an elongate structure having a first portion pivotably or rotationally coupled to portion 52 of frame 22 so as to pivot or rotate about axis 96 and a second portion pivotably or rotationally coupled or connected to cross-link 86 so as to pivot or rotate about axis 98.

Cross-link 86 comprises a bar, link, or the rigid structure extending across and between crank arms 82 and 84 and pivotably or rotatably coupled to crank arm 54 for rotation or pivotal movement about axes 92 and 98. Cross-link 86, along with crank arms 82, 84 and portion 52 of frame 22 form a four-bar linkage for raising and lowering cross-link 86 along a predefined path of motion. Cross-link 86 is further coupled to track 26L.

In the example illustrated, cross-link 86 serves as a platform, track, or other guiding surface supporting and guiding roller support 88. Cross-link 86 has a length greater than a maximum extent that roller support 88 may travel such a roller support 88 is always in contact with and supported by cross-link 86. Although cross-link 86 is illustrated as an elongate rectangular bar, in other embodiments, cross-link 86 may include a track, channel or groove for further guiding roller support 88 or may include and stops along axial ends for preventing roller support 88 from rolling off of cross-link 86.

Roller support 88 comprises one or more bearing structures operably coupled between cross-link 86 and track 26L, wherein the one or more bearing structures facilitate forward and rearward movement (left and right movement as seen in FIG. 2) of track 26L along cross-link 86 as cross-link 86 moves up and down. In the example illustrated, roller support 88 comprises one or more rollers rotationally coupled to and carried by track 26L, wherein the one or more rollers rolls along a top of cross-link 86. As a result, roller support 88 allows track 26L to both reciprocate along cross-link 86 and to pivot relative to cross-link 86. In other embodiments, other mechanisms may be used to allow track 26L to both reciprocate along cross-link 86 and to pivot relative to cross-link 86.

100261 Right drive 80 is substantially identical to left drive 78, except that right drive 80 oscillates track 26R. Right drive 80 includes crank arms 102, 104, cross-link 106 and roller support 108. Crank arm 102 comprises an elongate structure having a first portion pivotably or rotationally coupled to portion 52 of frame 22 so as to pivot or rotate about axis 90 and a second portion pivotably or rotationally coupled or connected to cross-link 106 so as to pivot or rotate about axis 112. Similarly, crank arm 104 comprises an elongate structure having a first portion pivotably or rotationally coupled to portion 52 of frame 22 so as to pivot or rotate about axis 96 and a second portion pivotably or rotationally coupled or connected to cross-link 106 so as to pivot or rotate about axis 118.

Cross-link 106 comprises a bar, link, or the rigid structure extending across and between crank arms 102 and 104 and pivotably or rotatably coupled to crank arms 102, 104 for rotational movement about axes 112 and 118. Cross-link 106, along with crank arms 102, 104 and portion 52 of frame 22 form a four-bar linkage for raising and lowering cross-link 106 along a predefined path of motion. Cross-link 106 and is further coupled to track 26R (shown in FIG. 1).

In the example illustrated, cross-link 106 serves as a platform, track, or other guiding surface supporting and guiding roller support 108. Cross-link 106 has a length greater than a maximum extent that roller support 108 may travel such a roller support 108 is always in contact with and supported by cross-link 106. Although cross-link 86 is illustrated as an elongate rectangular bar, in other embodiments, cross-link 106 may include a track, channel or groove for further guiding roller support 108 or may include end stops along axial ends for preventing roller support 108 from rolling off of cross-link 106.

Roller support 108 comprises one or more bearing structures operably coupled between cross-link 106 and track 26R, wherein the one or more bearing structures facilitate forward and rearward movement (left and right movement as seen in FIG. 3) of track 26R along cross-link 106 as cross-link 106 moves up and down. In the example illustrated, roller support 108 comprises one or more rollers rotationally coupled to and carried by track 26R (shown in FIGS. 1 and 4), wherein the one or more rollers roll along a top of cross-link 106. As a result, roller support 108 allows track 26R to both reciprocate along cross-link 106 and to pivot relative to cross-link 106. In other embodiments, other mechanisms may be used to allow track 26R to both reciprocate along cross-link 106 and to pivot relative to cross-link 106.

As further shown by FIGS. 3 and 4, track drive 28 is further configured to oscillate tracks 26R and 26L out of phase with one another. In the example illustrated contracts 26 are oscillated 180 degrees out of phase with one another. In other words, at any moment in time, tracks 26 are at completely opposite locations along their identical paths of motion. For example, when track 26L is rising and moving to the right (as seen in FIG. 3), track 26R is falling and moving to the left (as seen in FIG. 1).

In the example illustrated, to synchronize the oscillation of tracks 26 such that they are 180 degrees out of phase with one another, track drive 28 includes coupling shafts 120, 122. Coupling shaft 120 extends through portion 52 of frame 22 and is supported by one or more bearing structures, allowing shaft 120 to rotate. Shaft 120 has a first end fixed to crank arm 82 and a second end fixed to crank arm 102. As shown in FIGS. 3 and 5, crank arms 82 and 102 are fixed relative to shaft 120 at locations 180 degrees from one another. In other words, crank arms 82 and 102 extend in opposite directions from shaft 120.

Coupling shaft 122 is similar to coupling shaft 120. Coupling shaft 122 extends through portion 52 of frame 22 and is supported by one or more bearing structures, allowing shaft 122 to rotate. Shaft 122 has a first end fixed to crank arm 84 and a second end fixed to crank arm 104. As shown in FIGS. 3 and 4, crank arms 84 and 104 are fixed relative to shaft 122 at locations 180 degrees from one another. In other words, crank arms 84 and 104 extend in opposite directions from shaft 122.

Adjustable variable resistance source 29 comprises a source of resistance against oscillation and against upward and downward vertical movement of tracks 26. In the example illustrated, resistance source 29 is adjustable by user to adjust a degree of resistance such that the user may vary his or her workout characteristics. In the example illustrated, resistance source 29 is adjustable without tools and by the person excising simply entering one or more commands or inputs using control panel 42. In other embodiments, resistance source 29 may alternatively be adjusted mechanically using tools or in a tool less fashion.

In the example illustrated in FIG. 3, adjustable variable resistance source 29 comprises an Eddy brake system. In particular, resistance source 29 includes a ferrous member 124 and a magnetic member or magnet 126. Ferrous member 124 comprises a structure of iron, iron alloy or ferrous material fixed to shaft 120 so as to rotate with shaft 120. In the example illustrated, member 124 comprises a disk. In other embodiments, member 124 may of other configurations.

Magnet 126 comprises a magnetic member configured and located just to apply a magnetic field to member 124. In the example illustrated, magnet 126 extends generally opposite to a face of member 124. The magnetic field applied to member 124 by magnet 126 creates eddy currents that themselves create opposing magnetic fields that resist relative rotation of members 124 and 126. By resisting relative rotation of members 124, 126, rotation of shaft 120 is also resisted. As a result, oscillation of tracks 26 is resisted.

The resistance applied by members 24 and 26 is adjustable and selectable by a person exercising. In one embodiment, magnet 26 comprises an electromagnet, wherein electrical current transmitted through magnet 26 may be varied to just the magnetic field and the degree of resistance provided by source 29. In one embodiment, the electrical current transmitted to magnet 126 varies in response to electrical circuitry and control signals generated by a controller associate with control panel 42 in response to input from the person exercising or an exercise program stored in a memory associated, connected to or in communication with the controller of control panel 42.

In another embodiment, the resistance applied by members 24 and 26 may be adjustable by physically adjusting a spacing or gap between member 24 and magnet 26. For example, in one embodiment, source 29 may include an electric solenoid, voice coil or other mechanical actuator configured to move one of member 24 or magnet 26 relative to one another so as to adjust the gap. In yet other embodiments, magnet 26 may alternatively be fixed to shaft so as to rotate with shaft 90 while member 24 is stationarily supported by frame 22. In yet other embodiments, member 24 and magnet 26 may alternatively or additionally be coupled with respect to shaft 122 in a similar manner.

As shown by FIGS. 1, 2, 6 and 7, foot link assemblies 30 (also known as floating stair arms or floating stair arm assemblies) comprise structures which movably support foot pads 32. Foot link assemblies 30R and 30L are substantially identical to one another except that foot link assemblies 30R and 30L move along user selectable paths which substantially lie in parallel vertically oriented planes, one plane extending to the last of a centerline of axis of exercise device 20 in another plane extending to the right of the centerline of exercise device 20.

Figure 6:
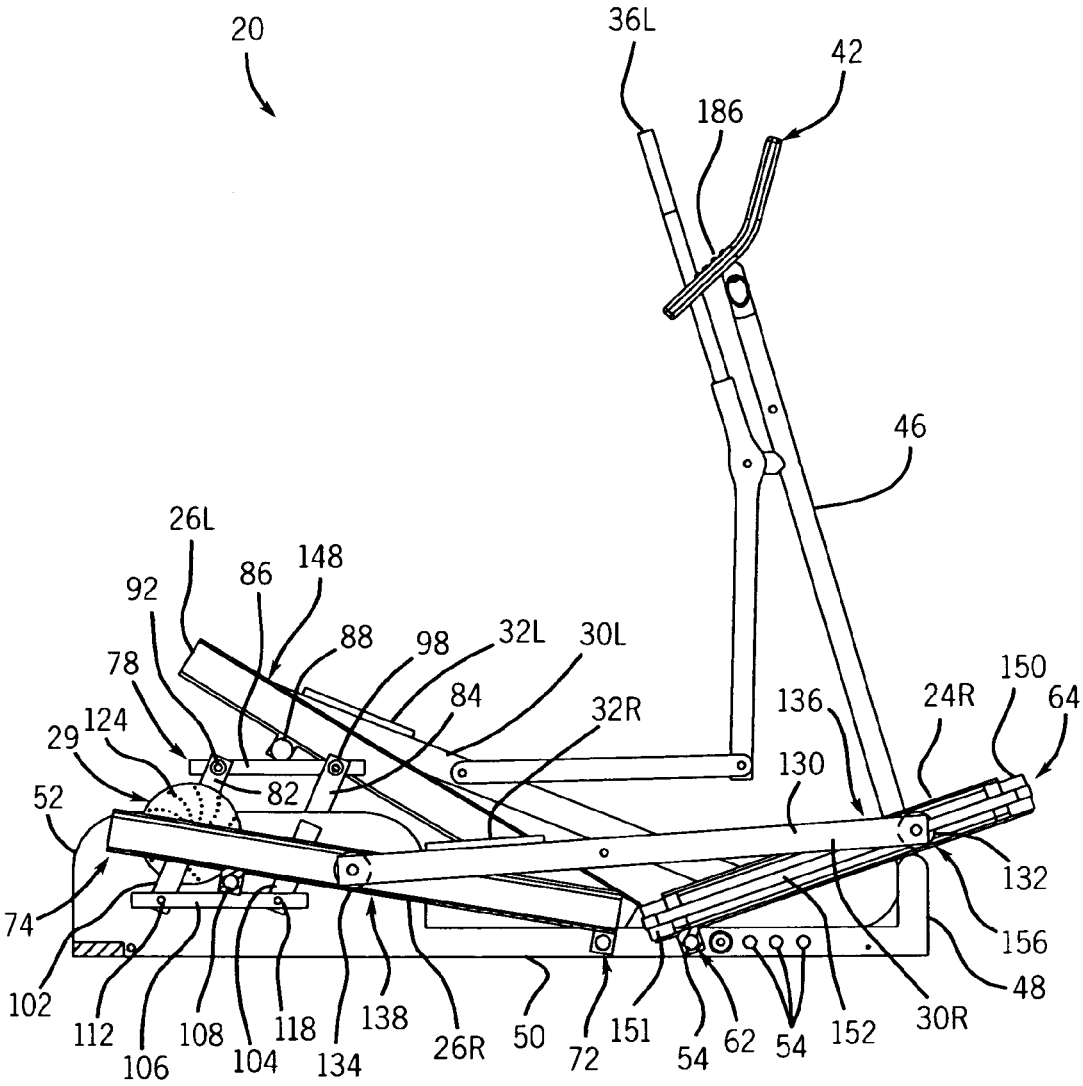
FIG. 6 is another sectional view from a first side of the exercise device of FIG. 1.

FIG. 6 is a sectional view illustrating foot link assembly 30R. As shown by FIG. 6, foot link assembly 30R includes foot link 130 and bearings 132, 134. Foot link 130 comprises an elongate bar or other structure coupled to and supporting foot pads 32R. Foot link 130 has a first portion 136 and a second portion 138. Portion 136 is coupled to ramp 24R so as to reciprocate along and pivot relative to ramp 24R. Portion 138 is coupled to track 26R so as to reciprocate along into a relative to track 26R.

Bearings 132, 134 facilitates a sliding or reciprocating movement of foot link 130 as well as pivoting or relative rotational movement of portions of a link 130 relative to ramp 24R and track 26R. In the example illustrated, bearing 132 comprises one or more rollers rotationally supported or rotationally coupled to portion 136 of foot link 130 and captured within or along ramp 24R. The rollers facilitate both reciprocal movement of portion 136 along ramp 24R as well as relative pivotal or rotational movement of portion 136 with respect to ramp 24R. In the example illustrated, bearing 134 is similar to bearing 132. Bearing 134 comprises one or more rollers rotationally supported or rotationally coupled to portion 138 of foot link 130 and captured within or along track 26R. The rollers facilitate both reciprocal movement of portion 138 along track 26R as well as relative pivotal or rotational movement of portion 138 with respect to track 26R.

In other embodiments, bearings 132 and 134 may have other configurations. For example, one or both of bearings 132 and 134 may alternatively comprise a slider pad or bar pivotally connected to portion 136 of foot link 130 and slidable within or along ramp 24. In other embodiments, bearings 132 and 134 may be omitted, wherein other structures facilitate such reciprocal including movement. For example, in another embodiment, portion 136 of foot link 130 include a shaft, pin, bar or other projection extending from a side of foot link 130 that extends into an elongated slot extending along ramp 24R. Likewise, portion 138 of foot link 130 also include a shaft, pin, bar or other projection extending from a side of foot link 130 that extends into an elongated slot extending along track 26R. In such embodiments, one or both of the slots are the projecting pins may provide with a low friction interface such as a low friction material or other mechanical bearing arrangements. In yet other embodiments, this relationship may be reversed, wherein foot link 130 includes a pair of elongated slots and wherein ramp 24R and track 26R each includes a projecting pin.

Figure 7:
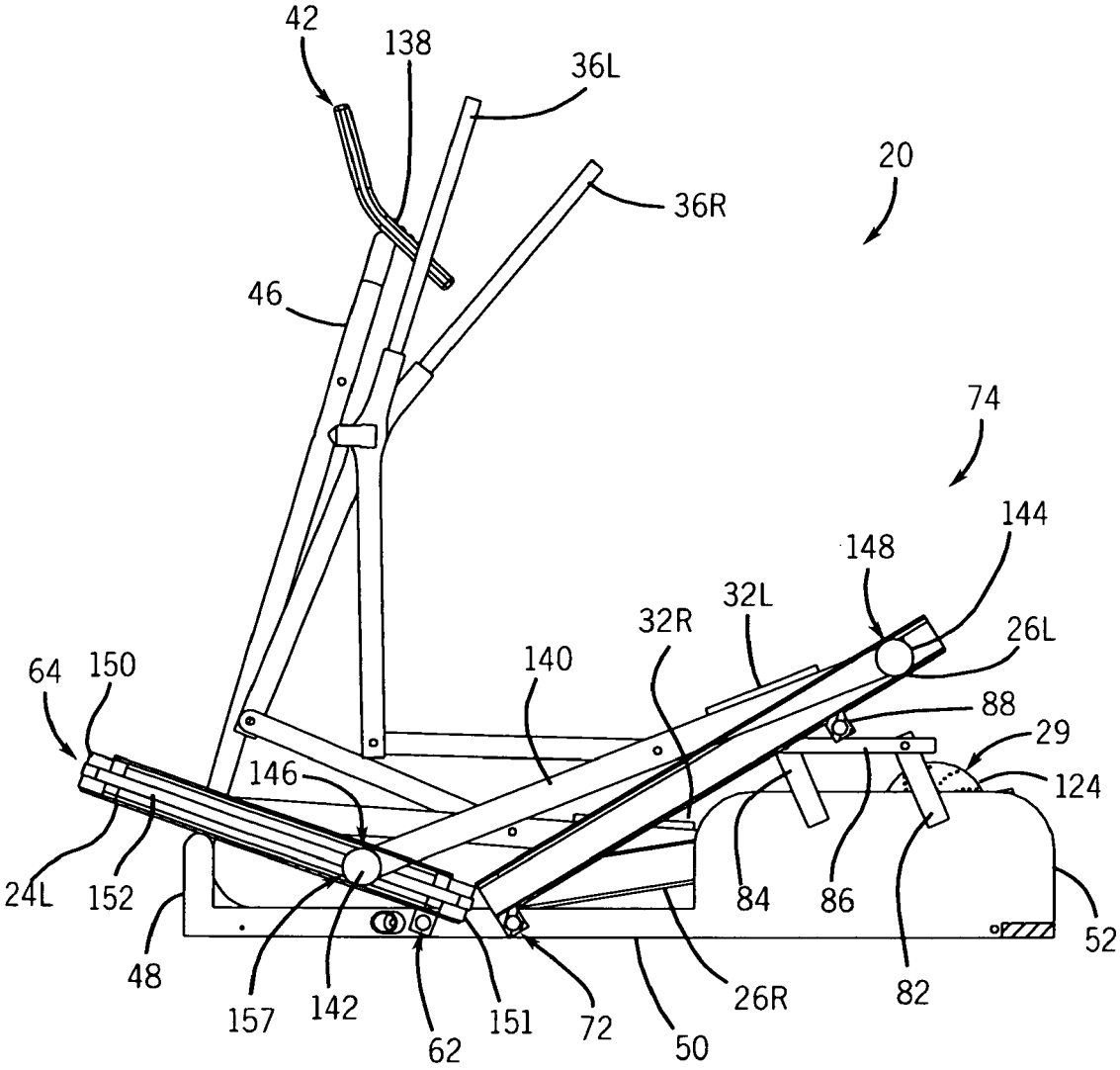
FIG. 7 is another sectional view from a second side of the exercise device and FIG. 1.

As shown by FIG. 7, foot link assembly 30L is substantially identical to foot link assembly 30R. Foot link assembly 30L includes foot link 140 and bearings 142, 144. Foot link 140 comprises an elongate bar or other structure coupled to and supporting foot pads 32L. Foot link 140 has a first portion 146 and a second portion 148. Portion 146 is coupled to ramp 24L so as to reciprocate along and pivot relative to ramp 24L. Portion 148 is coupled to track 26L says to reciprocate along into a relative to track 26L.

Bearings 142, 144 facilitates a sliding or reciprocating movement of foot link 140 as well as pivoting or relative rotational movement of portions of a link 140 relative to ramp 24L and track 26L. In the example illustrated, bearing 142 comprises one or more rollers rotationally supported or rotationally coupled to portion 146 of foot link 140 and captured within or along ramp 24L. The rollers facilitate both reciprocal movement of portion 146 along ramp 24L as well as relative pivotal or rotational movement of portion 146 with respect to ramp 24L. In the example illustrated, bearing 144 is similar to bearing 142. Bearing 144 comprises one or more rollers rotationally supported or rotationally coupled to portion 148 of foot link 140 and captured within or along track 26L. The rollers facilitate both reciprocal movement of portion 148 along track 26L as well as relative pivotal or rotational movement of portion 148 with respect to track 26L.

In other embodiments, bearings 142 and 144 may have other configurations. For example, one or both of bearings 142 and 144 may alternatively comprise a slider pad or bar pivotally connected to portion 146 of foot link 140 and slidable within or along ramp 24L. In other embodiments, bearings 142 and 144 may be omitted, wherein other structures facilitate such reciprocal including movement. For example, in another embodiment, portion 146 of foot link 140 include a shaft, pin, bar or other projection extending from a side of foot link 140 that extends into an elongated slot extending along ramp 24L. Likewise, portion 148 of foot link 140 also include a shaft, pin, bar or other projection extending from a side of foot link 140 that extends into an elongated slot extending along track 26L. In such embodiments, one or both of the slots or the projecting pins may be provided with a low friction interface such as a low friction material or other mechanical bearing arrangements. In yet other embodiments, this relationship may be reversed, wherein foot link 140 includes a pair of elongated slots and wherein ramp 24L and track 26L each include a projecting pin Foot link synchronizer 134 comprises a mechanism configured to synchronize movement of foot links 130, 140. In particular, foot link synchronizer 134 is configured to synchronize movement of foot links 130, 140 such that foot links 130, 140 are 180 degrees out of phase with one another. In other words, at any moment in time, foot links 130 and 140 are at complete opposite locations along their identical paths of motion. For example, when the link 130 is rising and moving to the right (as seen in FIG. 3), foot link 140 is falling and moving to the left (as seen in FIG. 1).

In the example embodiment illustrated in FIG. 1, synchronizer 434 includes rollers or pulleys 150, 151 and cable 152. Pulleys 150 are rotationally supported by the integral structure of ramps 24 at end 57 forward of ramps 24. Pulleys 151 are rotationally supported by the integral structure of ramps 24 between ramps 24 and tracks 26. Pulleys 150, 151 cooperate to maintain cable 152 in tension and to avoid periods of slack which would otherwise result in a jerk motion at times.

Cable 152 extends about or wraps about pulleys 150 and 151. Cable 152 has a first side portion 156 connected to portion 136 of foot link 130 (shown in FIG. 6) and a second opposite side portion 157 (shown in FIG. 7) connected to portion 146 of foot link 140 in a similar fashion. As a result, when foot link 130 is moving rearward or to the left as seen in FIGS. 1 and 6, foot link 140 must travel forward or to the left as seen in FIG. 7. In other embodiments, foot link synchronizer 34 may have other configurations or to make comprise other mechanisms. For example, in lieu of cable 152 comprising a single cable, cable 152 may comprise multiple cables. In place of the belt and pulleys shown, cable 152 may alternatively comprise a chain and one or more sprockets.

Swing arms 36 comprise elongated structures or assemblies of structures coupled to foot link assemblies 30 so as to swing, pivot or otherwise move with the movement of foot links 130, 140. Swing arms 36 facilitate exercisable person's upper body and arms in synchronization with the exercise of the person's lower body or legs. In other embodiments, swing arms 36 may be omitted or may be his connectable from foot links 130, 140 so as to be mounted to frame 22 in a stationary position.

Swing arm 36R has a first end portion 160 pivotally connected to foot link 130, a second intermediate portion 162 pivotally connected to upright 46 of frame 22 and a third end portion 164 providing a handgrip 168. Handgrip 168 is configured to be grasped by a person during exercise. In the example illustrated, handgrip 168 comprise columns, wraps, bands, rings or other surface areas of soft, compressible, high friction, rubber-like foam or polymeric material. In other embodiments, handgrip 168 may be omitted or may be generally indistinguishable from a remainder of swing arm 36R. In other embodiments, swing arm 36R may have other configurations. In still other embodiments, swing arm 36R may be omitted.

Swing arm 36L is substantially identical to swing arm 36R. Swing arm 36L has a first end portion 170 pivotally connected to foot link 140, a second intermediate portion 172 pivotally connected to upright 46 of frame 22 and a third end portion 174 providing a handgrip 178. Handgrip 178 is identically handgrip 168.

Variable resistance source 38 (also known as an adjustable resistance source) comprises a device or mechanism configured to provide a user controllable, selectable an adjustable resistance against the movement of foot links 130, 140. Variable resistance source 38 (schematically illustrated) may comprise any of a variety of different resistance mechanisms. For example, variable resistance source 38 may comprise an air brake or fan, wherein the fan is coupled to pulley 150 such that movement of foot links 130, 140 rotates the fan blades. Air resistance of the fan may be adjusted the changing angles of the fan blades to vary the resistance. In another embodiment, source 38 may comprise an electrical generator coupled to pulley 150. In yet another embodiment, source 38 make comprise a friction brake, wherein the degree of resistance may be adjusted by varying the degree of force between two frictional surfaces that are in contact with one another. In yet another embodiment, resistance source 38 make comprise and Eddy brake system coupled to pulley 50 (or another rotating member connected to the links 130, 140), wherein the distance separating a magnet and a ferromagnetic material may be selectively adjusted by a person to vary resistance. By allowing a person exercising to adjust the resistance against movement of full-length 130, 140, exercise device 20 permits a person to customize his or her workout characteristics.

Vertical height actuator 40 (schematically shown) comprises a mechanism configured to selectively raise and lower ramps 24 or to selectively adjust the inclination angle of ramps 24 to vary work out our excise characteristics. In one embodiment, vertical height actuator 40 is a powered actuator which utilizes electrical energy to raise or lower ramps 24. For example, in one embodiment, vertical height actuator 40 may comprise an electric solenoid configured to raise and lower ramps 24. In another embodiment, vertical height actuator 40 may comprise an electric motor in combination with a rack and pinion arrangement or rack and screw arrangement, wherein rotation of the screw or pinion drives a rack coupled to ramps 24 so as to raise and lower ramps 24. In other embodiments, vertical height actuator 40 may comprise a hydraulic or pneumatic cylinder-piston assembly computer raise and lower ramps 24. In lieu of raising and lowering end 64 of ramps 24, vertical height actuator 40 may alternatively selectively translate end 62 of ramps 24 in a horizontal direction to adjust an inclination angle of each of ramps 24. In still other embodiments, vertical height actuator 40 may be omitted.

Control panel 42 comprises a panel by which a person exercising may view current settings of exercise device 20 and may adjust the current settings of exercise device 20. Control panel 42 may additionally provide a person excising with feedback as to his or her exercise routine, such as duration, calories burned and the like, or may provide the person excising with instructions or objectives for an upcoming exercise routine are workout. In the example illustrated, control panel 42 includes display 184, input 186 and controller 188. Display 184 comprises a display configured to present information to a person excercising. Display 184 may comprise a liquid crystal display, an array of light emitting diodes or other devices for providing visual information.

Input 86 comprises one or more mechanisms by which a person excising may enter selections are commands. Input 86 may comprise a touchpad, a touch screen, toggle switches, one or more buttons, a mouse pad, a scroll wheel, a slider bar or various other input devices. Controller 188 comprises one or more processing units connected to display 184 and input 186 as well as variable resistance source 38 and variable height actuator 40. Controller 188 may also be connected to one or more sensors (not shown). Based on information received from resistance source 38, vertical height actuator 40 and the one or more sensors, controller 1 88 may generate control signals directing display 184 provide a person exercising with feedback as to his or her exercise routine or current settings of exercise device 20.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 188 may be embodied as part of one or more application-specific integrated circuits (ASICs). Unless otherwise specifically noted, the controller is not limited to any specific combination of hardware circuitry and software, nor to any particular source for the instructions executed by the processing unit. Based upon input received from into 186, controller 188 may generate control signals adjusting the resistance applied by resistance source 38 or adjusting a height of ramps 24 using variable height actuator 40. Such changes or adjustments may alternatively be made in response to stored programs or exercise routines associated with a memory of controller 188 or received by controller 188 through wired or wireless connections. In still other embodiments, display panel 42 may be omitted.

Figure 8:
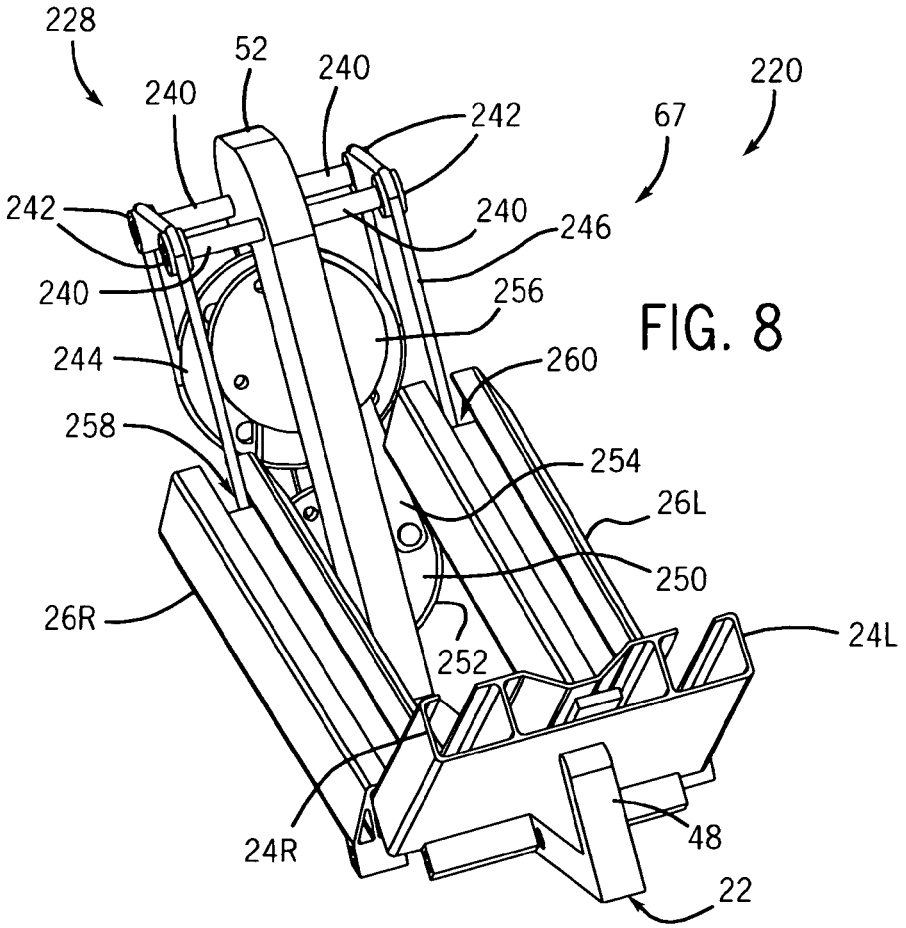
FIG. 8 is a sectional view of another embodiment of the exercise device of FIG. 1.
Figure 9:
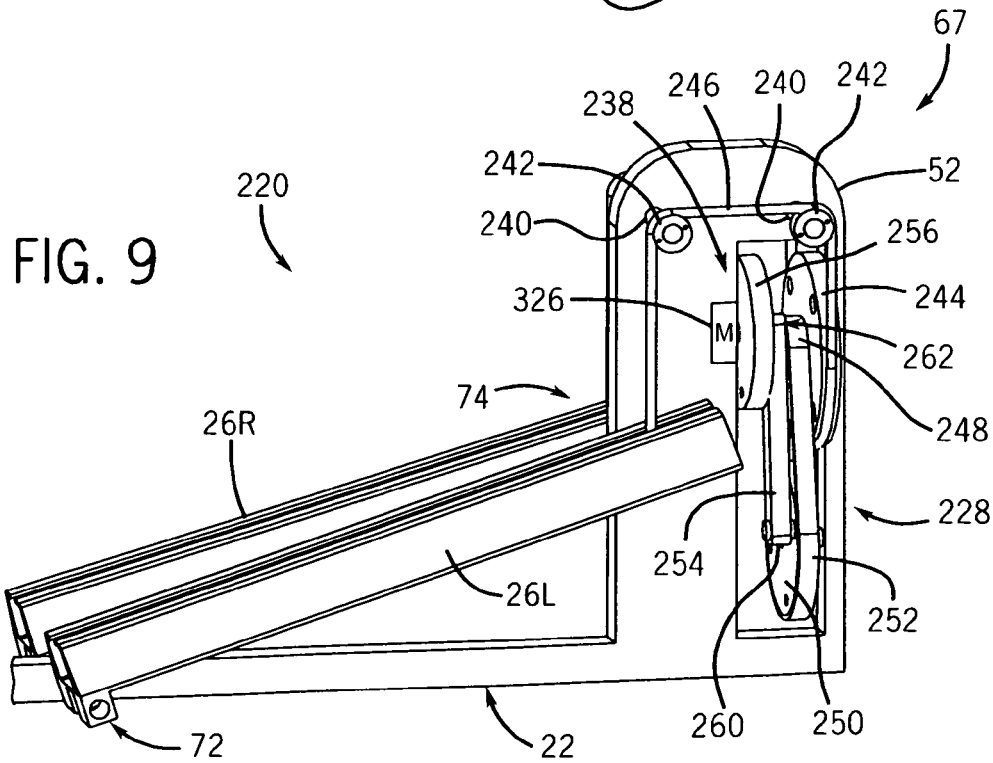
FIG. 9 is a fragmentary front perspective view of a portion of the exercise device of FIG. 8.

Overall, exercise device 20 provides a person exercising with multiple user selectable paths of motion for foot pads 32. A particular path a motion for foot pads 32 may be adjusted by user by the user simply applying different forces or directional forces to footpad 32 within his or her feet. Such changes in the motion paths may be made "on-the-fly" by the person excising during an exercise routine or workout without the person having to remove his or her hands from handgrips 168 or handgrips 178. Exercise devise automatically adapts to a person's motion or motion changes. Exercise device provides such freedom of motion with very few, if any, cantilevered members. For example, portions 136, 146 of foot links 130, 140 are supported by ramps 24. Opposite portions 138, 148 of foot links 130, 140 are supported by tracks 26. As a result, exercise device 20 provides a more solid and stable feel, may be formed from less structurally rigid materials and may be lighter in overall weight FIGS. 8 and 9 illustrate exercise device 220, another embodiment of exercise device 20 shown in FIGS. 1-7. Exercise device 220 is similar to exercise device 120 except that exercise device 220 includes track drive 228 and adjustable variable resistance source 238 in place of track drive 28 and adjustable variable resistance source 29, respectively. Like exercise device 20, exercise device 220 includes frame 22, ramps 24R, 24L (collectively referred to as ramps 24), tracks 26R, 26L (collectively referred to as tracks 26), adjustable variable horizontal resistance source 28, foot link assemblies 30R, 30L (collectively referred to as foot link assemblies 30), foot pads 32R, 32L (collectively referred to as foot pads 32), foot link synchronizer 34, swing arms 36R, 36L (collectively referred to as having arms 36), variable height actuator 40 and control panel 42, each of which is shown and described in FIG. 1.

Like track drive 28, track drive 228 comprises a drive mechanism configured to oscillate end 74 of tracks 26. Track drive 228 is located at a rear end 67 of exercise device 220 and is elevated or supported by elevating or supporting portion 52 of frame 22. Track drive 228 includes support posts 240, belt guides 242, pulley 244, belt 246, cluster pulley 248, intermediate pulley 250, belt 252, lever arm 254 and flywheel 256. Support posts 240 extend from portion 52 of frame 22 and support belt guides 242. Belt guides 242 comprise pulleys or rollers against which belt 246 partially wraps and is guided.

Pulley 244 is rotationally supported by portion 52 of frame 22. Belt 246 comprises a flexible a long gate member having a first end 258 connected or fixed to track 26R and a second opposite end 260 fastened mounted or otherwise secured to track 26L. Belt 246 wraps at least partially about guides 242 and about a lower end of pulley 244. As a result, belt 246 suspends end 74 of tracks 26 such that tracks 26 move in a phase relationship 180 degrees out of phase with respect to one another. In other words, as one of tracks 26 is rising, the other tracks 26 as falling.

Cluster pulley 248, pulley 250, belt 252, lever arm 254 and flywheel 256 serve to create momentum or inertia during the movement of tracks 26 to reduce or eliminate dead spots or dead zones where movement of tracks 26 would otherwise slow down such as when tracks 26 reach their upper or lower ends of travel. Cluster pulley 248 is fixedly coupled to or secured to pulley 244 so as to rotate with pulley 244. Cluster pulley 248 has a reduced outer diameter as compared to that of pulley 244. Pulley 250 is rotationally supported by portion 52 of frame 22. Belt 252 comprises a continuous belt wrapping about pulleys 248 and 250. Pulleys 248, 250 and belt 252 serve as a speed reducer.

Lever arm 254 comprises an elongate member having a first end 260 eccentrically and rotationally connected to pulley 250 and a second end of 260 eccentrically and rotationally connected to flywheel 256. Flywheel 256 is rotationally supported by portion 52 of frame 22. Lever arm 254 and the location to which ends a role 260 and 262 are connected to fly wheel 256 are configured such that as tracks 26 move up and down, their motion is transmitted to flywheel 256 so as to continuously rotate flywheel 256 in a single direction. This continuous rotation of flywheel 256 creates inertia or momentum to reduce or eliminate the occurrence of dead zones or stalled zones where movement of tracks 26 would otherwise be slowed or stalled at its ends of travel.

Vertical resistance source 238 comprises a source of controllable and adjustable resistance against the raising and lowering of ends 74 of tracks 26. In the example illustrated, vertical resistance source 238 comprises an Eddy brake system. In particular, vertical resistance source 238 includes a magnet 326 (schematically shown) positioned opposite to flywheel 256, wherein flywheel 256 is formed from a ferrous material.

Magnet 326 comprises a magnetic member configured and located just to apply a magnetic field to flywheel 256. In the example illustrated, magnet 326 extends generally opposite to a face of magnet 326. The magnetic field applied to flywheel 256 by magnet 326 creates eddy currents that themselves create opposing magnetic fields that resist relative rotation of flywheel 256. By resisting relative rotation fly wheel 256, rotation of pulley 244 is also resisted. As a result vertical up and down movement of tracks 26 is resisted.

The resistance applied by magnet 326 is adjustable and selectable by a person exercising. In one embodiment, magnet 326 comprises an electro-magnet, wherein electrical current transmitted through magnet 326 may be varied to just the magnetic field and the degree of resistance provided by source 238. In one embodiment, the electrical current transmitted to magnet 326 varies in response to electrical circuitry and control signals generated by a controller associate with control panel 42 in response to input from the person exercising or an exercise program stored in a memory associated, connected to or in communication with the controller of control panel 42.

In another embodiment, the resistance applied by magnet 326 may be adjustable by physically adjusting a spacing or gap between flywheel 256 and magnet 326. For example, in one embodiment, source 238 may include an electric solenoid, voice coil or other mechanical actuator configured to move one of flywheel 256 or magnet 326 relative to one another so as to adjust the gap. In yet another embodiment, flywheel 256 may include a magnet positioned opposite to a stationary ferrous member.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An exercise device comprising:

a frame;

a first ramp supported by the frame;

a first oscillating track having a first end pivotably coupled to the frame and a second end; and a first foot link having a first portion coupled to the first ramp so as to reciprocate along the first ramp relative to the first ramp and a second portion coupled to the first track so as to reciprocate along the first track while pivoting relative to the first track so as to move through a first selected one of a first plurality of different available paths and to change between the first plurality of different available paths in response to force applied by a person to the first foot link.

2. The exercise device of claim 1 further comprising:

a second oscillating track having a first end pivotably coupled to the frame and a second end; and a second foot link having a first portion coupled to the second ramp so as to reciprocate along the second ramp while pivoting relative to the second ramp and a second portion coupled to the second track so as to reciprocate along the second track while pivoting relative to the second track.

3. The exercise device of claim 2 further comprising a track drive configured to oscillate a first track and the second track by raising and lowering the first track and the second track.

4. The exercise device of claim 3, wherein the track drive is configured to raise and lower the first track and the second track 180 degrees out of phase with respect to one another.

5. The exercise device of claim 3, wherein the track drive comprises a crank arm assembly.

6. The exercise device of claim 5, wherein the crank arm assembly comprises:

a first crank arm having a first portion pivotally coupled to the frame and a second portion;

a second crank arm having a first portion pivotally coupled to the frame and a second portion;

a first link pivotably coupled to the second portion of the first crank arm and the second portion of the second crank arm, wherein the second end of the first track reciprocates and pivots along the first link;

a third crank arm having a first portion pivotally coupled to the frame and a second portion;

a fourth crank arm having a first portion pivotally coupled to the frame and a second portion;

a second link pivotably coupled to the second portion of the third crank arm and the fourth portion of the fourth crank arm, wherein the second end of the second track reciprocates and pivots along the first link.

7. The exercise device of claim 3, wherein the track drive comprises one or more cables connected to the first track and the second track.

8. The exercise device of claim 7, wherein the track drive further comprises a disk supported by the frame, wherein at least one of the cables is attached to the disk.

9. The exercise device of claim 2 further comprising an adjustable resistance source coupled to at least one of the first foot link and the second foot link so as to resist movement of at least one of the first foot link and the second foot link along at least one of the first ramp and the second ramp or a least one of the first track and the second track.

10. The exercise device of claim 2 further comprising:

a first swing arm having a first portion pivotally coupled to the first foot link, a second portion pivotally coupled to the frame and a first hand a grip portion; and a second swing arm having a first portion pivotally coupled to the second foot link and a second portion pivotally coupled to the frame and a second hand grip portion.

11. The exercise device of claim 2 further comprising a foot link synchronizer coupled to the first foot link and the second foot link and configured to synchronize reciprocation of the first foot link and the second foot link such that the first foot link and the second foot link reciprocate 180 degrees out of phase with respect to one another.

12. The exercise device of claim 11, wherein the foot link synchronizer comprises:

a pulley supported by the frame; and a cable wrapped around the pulley, the cable having a first end connected to the first foot link and a second end connected to the foot link.

13. The exercise device of claim 2, wherein the first ramp and the second ramp are movably coupled to the frame so as to be movable between a plurality of different positions relative to the frame.

14. The exercise device of claim 13, wherein the first ramp and a second ramp are pivotably coupled to the frame so as to be pivotable between a plurality of different inclinations.

15. The exercise device of claim 13 further comprising a variable height powered actuator configured to selectively move the first ramp and the second ramp relative to the frame.

16. The exercise device of claim 2, wherein the first portion of the first foot link and the first portion of the second foot link each include at least one roller configured to roll along the first track and the second track, respectively, and wherein the second portion of the first foot link and the second portion of the second foot link each include at least one roller configured to roll along the first ramp and the second ramp, respectively.

17. The exercise device of claim 2 further comprising handgrips, wherein the first ramp and the second ramp extend proximate a first end of the first track and the second track and wherein the handgrips are proximate the first end of the first track and the second track.

18. A method comprising:

reciprocating and pivoting a first portion of a first foot link along a first ramp while reciprocating and pivoting a second portion of the first foot link along a first oscillating track to move through a first selected one of a first plurality of different available paths and to change between the first plurality of different available paths in response to force applied by a person to the first foot link; and reciprocating and pivoting a first portion of a second foot link along a second ramp while reciprocating and pivoting a second portion of the second foot link along a second oscillating track to move through a second selected one of a second plurality of different available paths and to change between the second plurality of different available paths in response to force applied by a person to the second foot link.

19. The method of claim 18, wherein the reciprocating and the pivoting of the first portion of the first foot link and the first portion of the second foot link are 180 degrees out of phase with respect to one another.

20. The exercise device of claim 1, wherein the first foot link includes a first roller carried by the first portion of the first foot link and a second roller carried by the second portion of the first foot link.

* * * * *